US005232851A

United States Patent [19]

Cox et al.

[11] Patent Number: 5,232,851

[45] Date of Patent: Aug. 3, 1993

[54] METHODS FOR TREATING NON-DYED AND NON-FINISHED COTTON WOVEN FABRIC WITH CELLULASE TO IMPROVE APPEARANCE AND FEEL CHARACTERISTICS

[75] Inventors: Thomas C. Cox, Rock Hill, S.C.; Patrick E. Hawks, Charlotte, N.C.; Suanne A. Klahorst, San Mateo, Calif.

[73] Assignees: Springs Industries, Inc., Fort Mill, S.C.; Genencor International, Inc., S. San Francisco, Calif.

[21] Appl. No.: 598,506

[22] Filed: Oct. 16, 1990

[51] Int. Cl.[5] ..... D06M 16/00; D06M 13/00; C11D 1/00

[52] U.S. Cl. ..... 435/263; 435/264; 252/174.12; 8/116.1

[58] Field of Search ..... 435/263, 264, 265, 303, 435/304, 305; 139/36, 109, 294, 46; 19/201; 252/174.12; 8/116

[56] References Cited

U.S. PATENT DOCUMENTS

| | | | |
|---|---|---|---|
| 4,712,290 | 12/1987 | Lindsey | 435/263 |
| 4,738,682 | 4/1988 | Boegh et al. | 435/264 |
| 4,822,516 | 4/1989 | Suzuki et al. | 252/174.12 |
| 4,832,864 | 5/1989 | Olson | 252/174.12 |
| 4,891,096 | 1/1990 | Akkawi | 162/1 |
| 4,912,056 | 5/1990 | Olson | 435/263 |

FOREIGN PATENT DOCUMENTS

| | | | |
|---|---|---|---|
| 2838751 | 3/1980 | European Pat. Off. | 435/263 |
| 0265832 | 5/1988 | European Pat. Off. . | |
| 269977 | 6/1988 | European Pat. Off. . | |
| 2148278C2 | 9/1984 | Fed. Rep. of Germany . | |
| 58-36217 | 3/1983 | Japan . | |
| 58-54082 | 3/1983 | Japan . | |
| 64-40681 | 2/1989 | Japan . | |
| WO89/09259 | 10/1989 | PCT Int'l Appl. . | |
| 2094826A | 9/1982 | United Kingdom . | |
| 8903909 | 5/1989 | World Int. Prop. O. | 435/263 |

OTHER PUBLICATIONS

What's New—"Weight Loss Treatment to Soften The Touch of Cotton Fabric", *JTN*, p. 64 (Dec., 1988).

Ohishi, et al., "Reformation of Cotton Fabric by Cellulase", *Shizuoka-ken Hamamatsu Sen'i Kogyo Shikenjo Hokoku*, 25, pp. 5-9 (1987).

Wood, "Properties of Cellulolytic Enzyme System", *Biochem, Soc. Trans*, 13, pp. 407-410 (1985).

Asferg, et al., "Softening and Polishing of Cotton Fabrics by Cellulase Treatment", *ITB Dyeing/Printing/Finishing*, 2nd quarter, pp. 5-6 (1990).

"Cellulase Enzyme Treatments", Cotton, Inc., Technical Services Department (Aug. 30, 1989).

Yamagishi, "Reforming of Cellulosic Fiber With Cellulase", *The Shizuoka Prefectural Hamamatsu Textile Industrial Research Institute Report*, 24, pp. 54-61 (1986).

Thomsen, "Celluzyme: A New Enzymatic Concept", *Comun. Jorn. Com. Esp. Deterg.* 18, pp. 9-25 (1987).

*Primary Examiner*—David M. Naff
*Assistant Examiner*—Deborah K. Ware
*Attorney, Agent, or Firm*—Burns, Doane, Swecker & Mathis

[57] ABSTRACT

Non-dyed and non-finished cotton woven fabric is contacted with a cellulase solution with agitation under conditions so as to produce a cascading effect of the solution over the cotton woven fabric. When so conducted, the treated cotton woven fabric has improved feel and appearance characteristics as compared to the fabric prior to treatment. Additionally, such methods result in the removal of dead and immature cotton from the fabric.

14 Claims, No Drawings

METHODS FOR TREATING NON-DYED AND NON-FINISHED COTTON WOVEN FABRIC WITH CELLULASE TO IMPROVE APPEARANCE AND FEEL CHARACTERISTICS

BACKGROUND OF THE INVENTION

1. Field of the Invention

The present invention is directed to methods for improving the feel and appearance characteristics of cotton woven fabrics as well as the fabrics produced from these methods. In particular, the methods of the present invention are directed to contacting a cotton woven fabric with a cellulase solution in a manner wherein the contacting is conducted with agitation and under conditions so as to produce a cascading effect of the solution over the fabric. When so conducted, the treated cotton woven fabric has improved feel and appearance characteristics as compared to the fabric prior to treatment. Additionally, this process removes substantially all of the immature and dead cotton fibers from the fabric which provides for further improvements in the quality o the so treated fabric.

2. State of the Art

During or shortly after its manufacture, cotton fabrics are generally treated in a manner which improves their appearance and accordingly their quality. One means of improving the appearance and luster of such fabric is to treat the fabric with an alkaline reagent such as sodium hydroxide (caustic) and the like. This process of treating fabric with caustic is termed "mercerization" and provides beneficial results to the so treated fabric including increased dye yield, increased tensile strength, increased luster, and appearance However, use of such reagents raises handling problems and safety concerns.

Another generally recognized method to treat cotton fabrics is to contact the fabric prior to finishing with an aqueous cellulase solution. For instance.. Japanese Patent Application Nos. 58-36217 and 58-54082 as well as Ohishi et al., "Reformation of Cotton Fabric by Cellulase" and JTN December 1988 journal article "What's New—Weight Loss Treatment to Soften the Touch of Cotton Fabric" each disclose that treatment of cotton fabrics with cellulase results in an improved feel for the fabric. It is generally believed that this cellulase treatment removes cotton fuzzing and/or surface fibers which reduces the weight of the fabric. The combination of these effects imparts improved feel to the fabric, i.e., the fabric feels more like silk. Treatment times of up to 48 hours have been reported for such cellulase treatment of cotton fabrics. Specifically, Ohishi et al., reports treatment times of up to 16 hours; Japanese Patent Application No. 58-54082 reports treatment times of up to 24 hours; and Japanese Patent Application No. 64-40681 reports treatment times of up to 48 hours. Such prolonged treatment times place undue delays on the manufacturing processes and can result in unacceptable strength reduction in the fabric. See, for instance, Japanese Patent No. 58-54082.

It was also heretofore known to agitate the cellulase solution during exposure of the cotton fabric to this solution. Such agitation was conducted for the purpose of enhancing the effect of cellulase on the cotton fabric and results in a softer fabric. Without being limited to any theory, it is believed that such agitation of the solution results in agitation of the fabric so as to mechanically loosen fibers and accordingly, facilitates the action of the cellulase on the fabric. However, agitation by itself results only in improved softness of the fabric and does not provide improved feel and appearance (as these terms are later defined) to the fabric.

It was still further known in the art to treat dyed, cotton knitted fabrics with a cellulase solution under agitation and cascading conditions, for example, by use of a jet, for the purpose of removing loose fibers and threads common to these knitted fabrics. However, because it is believed that buffers could adversely affect dye shading with selected dyes on knitted fabrics, the cellulase treatment solutions employed in such processes generally do not contain buffer(s).

Lastly, it was also heretofore known that the treatment of denim apparel (i.e., finished fabric) with cellulase solutions under agitating and cascading conditions, i.e., in a rotary drum washing machine, would impart a "stone washed" appearance to the denim. However, an apparently essential feature of such a process is the use of multiple pieces of denim so as to provide significant fabric to fabric contact with consequent fabric rubbing which enhances the "stone washed" appearance.

In any event, the above described methods are contrasted with methods of cleaning garments with a cellulase containing laundry detergent composition because the cotton fabrics employed in the methods of improving their feel are generally newly manufactured (e.g., have not yet been fabricated into apparel, home furnishings, etc.) and usually have not yet been treated with a finishing agent. Furthermore, unlike detergent compositions, the cellulase compositions employed in improving the feel of cotton fabrics contain a higher concentration of cellulase as compared to cellulase concentrations in detergent compositions.

In spite of the above described methods, there is a continuing need for methods of upgrading the quality of cotton woven fabrics by treatment with a cellulase solution especially wherein the reaction time has been minimized, particularly during the manufacture of cotton woven fabric. It would be particularly desirable if such methods also resulted in fabrics having minimal strength loss as well as in improved appearance and feel as compared to fabrics prior to treatment.

SUMMARY OF THE INVENTION

The present invention is directed to the discovery that improved feel and appearance for cotton woven fabrics can be achieved by contacting the fabric with an aqueous cellulase solution wherein the contacting is conducted with agitation under conditions which also result in a cascading effect of the cellulase solution over the fabric. The improved feel and appearance in the fabric provide important improvements in the quality of the fabric because the consumer will attribute greater value to such fabrics. When treated in the manner of the present invention, the cellulase exposure time required to achieve improved feel and appearance for the treated cotton woven fabric is greatly reduced as compared to prior art cellulase treatment processes. Because the fabric is exposed to the cellulase solution for significantly shorter periods than those heretofore used, strength reduction in the fabric as a result of the cellulase treatment is expected to be reduced as compared to known cellulase exposure procedures used to improve the feel of cotton woven fabrics.

Accordingly, in one of its method aspects, the present invention is directed to a method of improving the feel and appearance of cotton woven fabric prior to the finishing of said fabric which comprises contacting said fabric with an aqueous cellulase solution containing a concentration of cellulase effective in improving the feel and appearance of said fabric while maintaining the cellulase solution at a pH within the range where the cellulase exhibits activity and wherein said contacting is conducted with agitation under conditions so as to produce a cascading effect of the cellulase solution over the fabric and further wherein said contacting is conducted at a temperature and for a duration of time effective in improving the feel and appearance of said fabric. Cotton woven fabric treated by this method will possess improved feel and appearance after a very short reaction period(s) as compared to prior art methods and will generally retain at least about 50% of its original warp tensile strength and at least about 50% of its original filling tensile strength.

In one of its composition aspects, the present invention is directed to a cotton woven fabric having improved feel and appearance. Such an improved fabric is characterized by the lack of fuzz and surface fibers on the fabric and further by a silky, smooth feel when touched.

In another of its composition aspects, the present invention is directed to a cotton woven fabric having improved feel and appearance which is prepared by the method which comprises contacting said fabric with an aqueous solution containing a concentration of cellulase effective in improving the feel and appearance of said fabric while maintaining the pH of the cellulase solution within the range where the cellulase exhibits activity and wherein said contacting is conducted with agitation under conditions so as to produce a cascading effect of the cellulase solution over the fabric and further wherein said contacting is conducted at a temperature and for a duration of time effective in improving the feel and appearance of said fabric.

DETAILED DESCRIPTION OF THE PREFERRED EMBODIMENTS

As noted above, the compositions and methods of this invention provide for cotton woven fabrics having improved feel and appearance. Both the improved feel and the improved appearance result in higher quality products, i.e., products which are more valued by the consumer because of the improvements in feel and appearance. However, prior to discussing this invention in detail, the following terms will first be defined.

The term "cotton woven fabric" means woven fabrics made of pure cotton or cotton blends. When cotton blends are employed, the amount of cotton in the fabric should be at least about 40 percent by weight percent cotton; preferably, more than about 60 percent by weight cotton; and most preferably, more than about 75 percent by weight cotton. When employed as blends, the companion material employed in the fabric can include one or more non-cotton fibers including synthetic fibers such as polyamide fibers (for example, nylon 6 and nylon 66), acrylic fibers (for example, polyacrylonitrile fibers), and polyester fibers (for example, polyethylene terephthalate), polyvinyl alcohol fibers (for example, Vinylon), polyvinyl chloride fibers, polyvinylidene chloride fibers, polyurethane fibers, polyurea fibers and aramid fibers. It is contemplated that regenerated cellulose, such as rayon, could be used as a substitute for cotton in the methods of this invention.

The term "finishing" as employed herein means the application of a sufficient amount of finish to the fabric so as to substantially prevent cellulolytic activity of the cellulase on the fabric. Finishes are generally applied at or near the end of the manufacturing process of the fabric. for the purpose of enhancing the properties of the fabric, for example, softness, drapability, etc., which additionally protects the fabric from reaction with cellulases. Finishes useful for finishing a cotton woven fabric are well known in the art and include resinous materials, such as melamine, glyoxal, or ureaformaldehyde, as well as waxes, silicons, fluorochemicals and quaternaries. When so finished, the cotton fabric is substantially less reactive to cellulase.

The term "cellulase" as employed herein refers to a multi-enzyme system derived from a microorganism which acts on crystalline forms of cellulose and its derivatives to hydrolyze cellulose and give primary products, glucose and cellobiose. Such cellulases are synthesized by a large number of microorganisms including fungi, actinomycetes, gliding bacteria (mycobacteria) and true bacteria. Some microorganisms capable of producing cellulases useful in the methods disclosed herein are disclosed in British Patent No. 2 094 826A, the disclosure of which is incorporated herein by reference Most cellulases generally have their optimum activity in the acidic or neutral pH range. On the other hand, alkaline cellulases, i.e., cellulases showing optimum activity in neutral or alkaline media, are also known in the art. Microorganisms producing alkaline cellulases are disclosed in U.S. Pat. No. 4,822,516, the disclosure of which is incorporated herein by reference. Other references disclosing alkaline cellulases are EPA Publication No. 269,977 and EPA Publication No. 265,832, the disclosures of which are also incorporated herein by reference.

Cellulase produced by a microorganism is sometimes referred to herein as a "cellulase system" to distinguish it from the classes and components of cellulase isolated therefrom. Such classes and components are well known in the art and include exo-cellobiohydrolase components ("CBH components"), endoglucanase components ("EG components") and $\beta$-glucosidase components ("BG components").

The CBH components and EG components are known in the art to synergistically interact with each other to provide enhanced activity against cellulose. Thus, while a cellulase system derived from any microorganism can be employed herein, it may be preferable that the cellulase system contain at least one CBH component and at least one EG component so that enhanced cellulase activity is achieved.

On the other hand and in a further preferred embodiment, the cellulase employed may be preferably enriched in endoglucanase components. See U.S. Ser. No. 07/593,919, filed on Oct. 5, 1990 by Ward et al. entitled "TRICHODERMA REESEI CONTAINING DELETED CELLULASE GENES AND DETERGENT COMPOSITIONS CONTAINING CELLULASE DERIVED THEREFROM", which is incorporated herein by reference. Such EG enriched cellulases can also be achieved by purifying a cellulase system into its components and then recombining requisite amounts of components. See PCT Application Publ. No. W089/09259, which is incorporated herein by reference.

The fermentation procedures for culturing cellulolytic microorganisms for production of cellulase are known per se in the art. For example, cellulase systems can be produced either by solid or submerged culture, including batch, fed-batch and continuous-flow processes. The collection and purification of the cellulase systems from the fermentation broth can also be effected by procedures known per se in the art.

Preferred cellulases for use in this invention are those obtained from *Trichoderma reesei, T. koningii, Pencillum sp., Humicola insolens*, and the like. Certain cellulases are commercially available, i.e., CELLUCLAST (available from Novo Industry, Copenhagen, Denmark), RAPIDASE (available from Gist Brocades, N.V., Delft, Holland), CYTOLASE 23 (available from Genencor International, South San Francisco, Calif.) and the like. Other cellulases can be readily isolated by art recognized fermentation and isolation procedures.

The term "buffer" refers to art recognized acid/base reagents which stabilize the cellulase solution against undesired pH shifts during the cellulase treatment of the cotton woven fabric. In this regard, it is art recognized that cellulase activity is pH dependent. That is to say that a specific cellulase will exhibit cellulolytic activity within a defined pH range with optimal cellulolytic activity generally being found within a small portion of this defined range. The specific pH range for cellulolytic activity will vary with each cellulase As noted above, while most cellulases will exhibit cellulolytic activity within an acidic to neutral pH profile, there are some cellulases which exhibit cellulolytic activity in an alkaline pH profile.

During cellulase treatment of the cotton woven fabric, it is possible that the pH of the initial cellulase solution could be outside the range required for cellulase activity. It is further possible for the pH to change during treatment of the cotton woven fabric, for example, by the generation of a reaction product which alters the pH of the solution. In either event, the pH of an unbuffered cellulase solution could be outside the range required for cellulolytic activity. When this occurs, undesired reduction or cessation of cellulolytic activity in the cellulase solution occurs. For example, if a cellulase having an acidic activity profile is employed in a neutral unbuffered aqueous solution, then the pH of the solution will result in lower cellulolytic activity and possibly in the cessation of cellulolytic activity. On the other hand, the use of a cellulase having a neutral or alkaline pH profile in a neutral unbuffered aqueous solution should initially provide significant cellulolytic activity.

In view of the above, the method of this invention provides that the pH of the cellulase solution is maintained within the range required for cellulolytic activity. One means of accomplishing this is by simply monitoring the pH of the system and adjusting the pH as required by the addition of either an acid or a base. However, in a preferred embodiment, the pH of the system is preferably maintained within the desired pH range by the use of a buffer in the cellulase solution. In general, a sufficient amount of buffer is employed so as to maintain the pH of the solution within the range wherein the employed cellulase exhibits activity. Insofar as different cellulases have different pH ranges for exhibiting cellulase activity, the specific buffer employed is selected in relationship to the specific cellulase employed The buffer(s) selected for use with the cellulase employed can be readily determined by the skilled artisan taking into account the pH range and optimum for the cellulase employed as well as the pH of the cellulase solution. Preferably, the buffer employed is one which is compatible with the cellulase and which will maintain the pH of the cellulase solution within the pH range required for optimal activity. Suitable buffers include sodium citrate, ammonium acetate, sodium acetate, disodium phosphate, and any other art recognized buffers.

The term "feel" (also referred to as "hand") as used herein refers to the physical smoothness of a cotton woven fabric to touch. Fabrics having improved feel are smoother and silkier to the touch than other fabrics and accordingly are viewed as higher quality products. As defined, the term feel is distinguished from qualities such as softness (which refers to the pliability of the fabric rather than its feel), thickness, color, or other physical characteristics not involved in smoothness of the fabric. As noted above, such qualities (e.g. softness) can be achieved by treating a cotton woven fabric to a cellulase solution with agitation but without cascading effect.

The term "appearance" as used herein refers to the physical appearance of the cotton woven fabric to the eye and is determined in part, by the presence or absence of, fuzz, surface fibers, and the like on the surface of the fabric as well as by the ability or inability to discern the construction (weave) of the fabric. Fabrics which have little if any fuzz and surface fibers and wherein the construction (weave) is clearly discernable possess improved appearance as compared to fabrics having fuzz and/or loose fibers and/or an indiscernible weave.

In general, the improvements in feel and appearance of cotton woven fabrics after treatment by the methods of the present invention are readily ascertained by simple analytical tests which provide a numerical rating to the fabric both before and after treatment by the methods of this invention. The test procedure is conducted as a side-by-side comparison of a fabric sample before treatment by the process of this invention with a sample of that fabric after treatment by the process of this invention.

Specifically, the analytical test for appearance utilizes the 2 fabric samples (unlabeled), i.e., one before treatment and one after treatment by the process of this invention. The fabrics are visually evaluated for appearance and rated on a 1 to 10 scale by a minimum of seven individuals. The rating assigned to each fabric is based on appearance qualities such as the presence or absence of fuzz and/or loose fibers and/or a discernible weave. The scale has two standards to allow meaningful comparisons The first standard is a test fabric of cotton sheeting (Style No. 467) available from Testfabrics, Inc. (200 Blackford Ave., Middlesex, N.J. 08846) which for the purposes of this analysis is assigned an appearance rating of 3. The second standard is a test fabric of mercerized combed cotton broadcloth (Style No. 419) available from Testfabrics, Inc. (200 Blackford Ave., Middlesex, N.J. 08846) which for the purposes of this analysis is assigned an appearance rating of 7. The fabric to be rated is provided a rating of 3 or 7 if the fabric appears substantially the same as the first or second standard respectively. Rating of 1–2 represent fabrics having incrementally poorer appearances than the first standard; ratings of 8–10 represent fabrics having incrementally better appearances than the second standard; and ratings of 4–6 represent fabrics having incrementally better appearances than the first standard but incrementally poorer appearances than the second standard. After complete analysis of the two fabrics, the values assigned to each fabric by all of the individuals are added and an average value generated. Fabrics treated by the process of this invention are defined as having an improved appearance if the average value assigned to that fabric is at least 0.5 greater, and preferably at least 1 number greater, than the average value assigned to that fabric prior to treatment.

After the two fabrics have been rated for appearance, the fabrics are then rated for feel. The analytical test for feel utilizes the 2 fabric samples (unlabeled), one before treatment and one after treatment by the process of this invention. The fabrics are manually evaluated for feel and rated on a 1 to 10 scale by a minimum of seven individuals. The rating assigned to each fabric is based on feel qualities such as smoothness and silkiness. The scale has two standards to allow meaningful comparisons. The first standard is a test fabric of cotton twill (Style No. 471) available from Testfabrics, Inc. (200 Blackford Ave., Middlesex, N.J. 08846) which for the purposes of this analysis is assigned a rating of 3. The second standard is a test fabric of mercerized combed cotton broadcloth (Style No. 419) available from Testfabrics, Inc. (200 Blackford Ave., Middlesex, N.J. 8846) which for the purposes of this analysis is assigned a rating of 7. The fabric to be rated is given a rating of 3 or 7 if the fabric feels substantially the same as the first or second standard respectively. Rating of 1-2 represent fabrics having incrementally poorer feel than the first standard; ratings of 8-10 represent fabrics having incrementally better feel than the second standard; and ratings of 4-6 represent fabrics having incrementally better feel than the first standard but incrementally better feel than the second standard. After complete analysis of the two fabrics, the values assigned to each fabric are added and an average value generated. Fabrics treated by the process of this invention are defined as having an improved feel if the average value assigned to that fabric is at least 0.5 greater, and preferably at least 1 greater, than the average value assigned to that fabric prior to treatment.

The term "agitation" as used herein means any mechanical and/or physical force which so agitates the cellulase solution so as to result in agitation of the cotton woven fabric but without significant fabric to fabric contact. Without being limited to any theory, it is believed that such agitation facilitates the removal (clipping) of loose fibers, surface fibers (fuzz) and the like from the cotton woven fabric. As is apparent, the agitation required in the methods described herein defines a vigorous action of the cellulase solution against the fabric surface which is substantially greater than mere mechanical stirring of the cellulase solution in order to achieve uniform cellulase concentration throughout the cellulase solution.

Agitation suitable for use in the methods described herein can be achieved, for example, by employing a laundrometer, a jig, a jet, a mercerizer, a beck, a paddle machine, continuous bleach range, continuous wash range and the like.

The agitation employed herein is either repetitive (e.g., intermittent) or continuous agitation. For example, the cellulase solution can be continuously agitated by employing a laundrometer, a jet and the like. In a laundrometer, the cotton woven fabric is loaded into stainless steel water-tight canisters. Continuous agitation is achieved by rotation of the fixed canisters on a frame within a temperature adjustable water bath. The degree of agitation is defined by the speed at which the canisters rotate. In a preferred embodiment, canisters rotated at a speed of at least about 40 revolutions per minute (rpms) achieve the agitation effect required in the herein described methods. Laundrometers are well known in the textile art and are generally employed as laboratory equipment. Suitable laundrometers are commercially available from, for example, Custom Scientific Instruments, Inc., Cedar Knolls, N.J.

In a jet, the cotton woven fabric, in a rope form, continuously rotates through and with the cellulase solution. Specifically, jets are based on a venturi tube in which the circular movement of liquor carries the fabric with it in a totally enclosed tubular chamber, annular in shape. The tubular chamber is filled in part with solution and the fabric is rotated through the chamber via a lifter roller so that at any given time a portion of the fabric is being lifted upward. The venturi tube is a constriction in the annular passage through which the speed of the flow of the liquor must be increased, thus causing suction which imparts movement to the fabric. The primary flow is given by a centrifugal pump, but it is usual to incorporate also a few inclined steam jets to boost the movement of both the fabric and the liquor. The movement of the fabric through the jet, preferably at a rate of at least about 6 ft/sec, provides the agitation required in the herein described methods.

Jets are well known apparatuses found in mills and are generally used for the purpose of dyeing and after-treating fabrics.

Repetitive agitation can be achieved by employing a jig, a mercerizer, a beck, and the like. A jig is a well known apparatus found in mills manufacturing cotton fabrics and is generally used for the purpose of scouring fabrics prior to dyeing. In a jig, a defined length of cotton woven fabric, in its open width position, is maintained on and between two rollers wherein the fabric is passing from one roller which is in the unwinding stage to a second roller which is in the winding stage. Once the unwinding/winding process is completed, the process is reversed so that the previous unwinding roll becomes the winding roll and the previous winding roll becomes the unwinding roll. This process is continuously conducted during the entire cellulase treatment time. A trough containing the cellulase solution is placed between the two rollers and the rollers are adjusted so that the cotton woven fabric becomes immersed in the cellulase solution as it passes from one roller to the other.

Repetitive agitation is achieved in the jig by continuously rolling and unrolling the cotton woven fabric from the rolls, preferably at a rate of speed of at least about 1 yd/sec and more preferably at least about 1.5 yd/sec so that at any given time, part of the length of the fabric is moving through the cellulase solution at this defined rate of speed. The net result of such rolling and unrolling is that any given time a portion of the cotton woven fabric found on the rolls is immersed in the cellulase solution and over a given period of time, all of the fabric (except for the very terminal portions found at either end of the fabric--these terminal ends are often composed of leader fabric, i.e., fabric sewn to the terminal portions of the treated fabric and which is not intended to be treated) has been immersed into the cellulase solution. Moving the fabric, preferably at a rate of speed of at least about 1 yd/sec, through the cellulase solution provides the agitation required in the herein described methods.

A mercerizer unit is similar to a jig in that the cotton fabric, in its open width position, is passed through a trough of solution, e.g., cellulase solution, at a set speed. Passing the cotton fabric through the trough, preferably at a speed of at least 1 yd./sec., and more preferably at a rate of at least 1.5 yd/sec, provides the agitation required in the herein described methods. The mercerizer unit operates in only one direction and the length of time the fabric is exposed to the cellulase solution can be varied by modifying the mercerizer so as to contain more than one trough. In this embodiment, the length of time the fabric is exposed in such a modified mercerizer depends on the number of troughs and the speed the fabric is moving through the troughs.

When repetitive agitation is employed, each portion of the cotton woven fabric is preferably exposed to the cellulase solution under agitating conditions at least once every minute on average, and more preferably at least 1.5 times every minute on average. For example, when a jig is employed, this required degree of repetitive agitation can be achieved by limiting the length of the fabric so that when conducted at the requisite speed, each portion of the cotton woven fabric is exposed to the cellulase solution under agitating conditions at least once every minute on average. When a modified mercerizer is employed, the desired degree of repetitive agitation can be achieved by adding a sufficient number of troughs appropriately spaced so that the fabric repetitively passes through different troughs.

As used herein, the term "cascading" means the rapid flow of cellulase solution across and eventually away from the surface of the cotton woven fabric. That is to say that cascading occurs when a stream of cellulase solution (liquid) is moving on and relative to at least part of the surface of the cotton woven fabric and this stream eventually moves away from this part of the surface of the fabric. A cascading effect can be achieved, for example, by use of a laundrometer, a jig, a jet, a mercerizer and the like. For example, when a laundrometer is employed, rotation of a partially filled canister will result in movement of the cellulase solution relative to the surface of the cotton woven fabric thereby creating a flow of cellulase solution across and eventually off part of the surface of the cotton woven fabric thereby resulting in a cascading effect. When the canister is rotated at the requisite rpms needed to achieve agitation, the flow of cellulase solution will be sufficiently rapid so as cause agitation and additionally create a cascading effect of the cellulase solution. When such a cascading effect is desired, the canister should be filled to no greater than about 75 percent of capacity, and preferably no greater than about 50 percent capacity.

Cascading can also be accomplished with the use of a jig. For example, when a jig is employed to achieve the requisite agitation described above, the cotton woven fabric rapidly departs from the trough containing the cellulase solution and is lifted somewhat upward in order to be wound onto the winding roller. When this occurs, any cellulase solution remaining on the surface of the cotton woven fabric as it exits from the cellulase solution rapidly flows across and eventually off this part of the fabric surface. Specifically, cascading in a jig is achieved by the passage of the cotton woven fabric through the cellulase solution, preferably at a speed of at least 1 yd/sec and more preferably at a speed of at least 1.5 yd/sec, coupled with the gravitational effect of the upward lift of the fabric as it is being rolled which results in the rapid flow of the cellulase solution across and eventually away from the surface of the cotton woven fabric theretofore covered with the cellulase solution.

Cascading can also be accomplished by use of a jet. Specifically, movement of the fabric relative to the cellulase solution provides agitation whereas rotation of the fabric upward and downward during rotation in the circular jet results in solution cascading over and from the fabric When the fabric is so moved, preferably at a rate of at least about ft/sec, through the jet, cascading of the cellulase solution on the fabric is achieved.

Without being limited to any theory, it is believed that when the cellulase solution is agitated and cascaded during cellulase treatment, the reaction time required to achieve the desired improvements in feel and appearance in the cotton woven fabric is unexpectedly reduced. Because of this reduction in reaction time, the cotton woven fabric is exposed to the cellulase solution for shorter periods of time which results in less strength loss from cellulase exposure. This reduction in strength loss arising from shorter cellulase exposure times more than offsets any increase in strength loss arising from agitating and cascading the cellulase solution. The net result is that with all other factors being equal, (e.g., reaction temperature, cellulase concentration, buffer concentration, etc.), use of agitation and cascading during the cellulase treatment results in substantially shorter reaction times for exposure of the cotton woven fabric to the cellulase solution as compared to the reaction time required for cellulase treatment without agitation and cascading Additionally and as noted above, agitation and cascading of the cotton woven fabric results in improvements in the feel and appearance of the so treated fabric.

The tensile strength of cotton woven fabrics is generally measured in a warp and filling direction which are at right angles to each other. Accordingly, the term "warp tensile strength" as used herein refers to the tensile strength of the cotton woven fabric as measured along the length of the cotton woven fabric whereas the term "filling tensile strength" refers to the tensile strength of the cotton woven fabric as measured across the width of the cotton woven fabric. The tensile strength of the resulting cotton woven fabric treated with a cellulase solution is compared to its tensile strength prior to treatment with the cellulase solution so as to determine the strength reducing effect of the treatment. If the tensile strength is reduced too much, the resulting cotton woven fabric will easily tear and/or form holes. Accordingly, it is desirable to maintain a tensile strength (both warp and filling) after treatment which is at least about 50% of the tensile strength before treatment The tensile strength of cotton woven fabrics is readily conducted following ASTM D1682 test methodology. Equipment suitable for testing the tensile strength of such fabrics include a Scott tester or an Instron tester, both of which are commercially available. In testing the tensile strength of cotton woven fabrics which have been treated with cellulase solutions, care should be taken to prevent fabric shrinkage after treatment and before testing. Such shrinkage would result in erroneous tensile strength data.

Improved feel and appearance for cotton woven fabric is achieved by the methods described herein by contactin9 said fabric with an aqueous solution containing cellulase under conditions so that the solution is agitated and so that a cascading effect of the cellulase solution over the cotton woven fabric achieved. The cotton woven fabrics treated by the methods herein described possess warp and filling tensile strength values which are at least about 50% of the warp and filling tensile strength values of the fabric prior to treatment; preferably, at least about 60% of the warp and filling tensile strength values of the fabric prior to treatment; and more preferably, at least about 90% of the warp and filling tensile strength values of the fabric prior to treatment.

In addition to improving the feel and appearance of cotton woven fabrics, it has been found that the methods of the present invention additionally result in the removal of immature and dead cotton from the fabric. For the purposes of this application, immature and dead cotton is cotton fiber which has not grown to maturity. When such immature and dead cotton is incorporated into yarn and, in turn, into cotton fabric, the immature and dead cotton will dye lighter than mature cotton which results in undesirable specks on the fabric. As noted above, cellulase treatment in accordance with this invention removes a portion of the immature and dead cotton. This results in improved uniformity of the dye shade when the fabric is dyed which, in turn, imparts higher quality to the fabric.

The aqueous cellulase solution contains cellulase and other optional ingredients including, for example, a buffer, a surfactant, a scouring agent, and the like. The concentration of cellulase employed in this solution is generally a concentration sufficient for its intended purpose. That is to say that an amount of cellulase is employed to provide improved feel and appearance (e.g., by agitating the cellulase solution under conditions so as to produce a cascading effect of the cellulase solution over the fabric during treatment of the cotton woven fabric). The amount of cellulase employed is also dependent on the equipment employed to achieve agitation and cascading, the process parameters employed (e.g., the speed of the canisters in a laundrometer, the speed of the fabric in a jig, etc., the temperature of the cellulase solution, and the like), the exposure time to the cellulase solution, the cellulase activity (e.g., a cellulase solution will require a lower concentration of a more active cellulase system as compared to a less active cellulase system), and the like. The exact concentration of cellulase can be readily determined by the skilled artisan based on the above factors as well as the desired effect. Lastly, if repetitive agitation is employed, particularly in a jig or a mercerizer, higher concentrations of cellulase are generally employed as compared to the concentrations of cellulase employed with continuous agitation. Preferably, the concentration of the cellulase in the cellulase solution employed herein is from about 0.065 gram/liter of cellulase solution to about 1.0 grams/liter of cellulase solution; and more preferably, from about 0.2 grams/liter of cellulase solution to about 0.4 grams/liter of cellulase solution. (The cellulase concentration recited above refers to the weight of protein)

When a buffer is employed in the cellulase solution, the concentration of buffer in the aqueous cellulase solution is that which is sufficient to maintain the pH of the solution within the range wherein the employed cellulase exhibits activity which, in turn, depends on the cellulase employed. The exact concentration of buffer employed will depend on several factors which the skilled artisan can readily take into account. For example, in a preferred embodiment, the buffer as well as the buffer concentration are selected so as to maintain the pH of the cellulase solution within the pH range required for optimal cellulase activity. In general, buffer concentration in the cellulase solution is about 0.005 N and greater. Preferably, the concentration of the buffer in the cellulase solution is from about 0.01 to about 0.5 N, and more preferably, from about 0.05 to about 0.15 N. In general, increased buffer concentrations in the cellulase solution are believed to enhance the rate of tensile strength loss of the treated fabric In addition to cellulase and a buffer, the cellulase solution can optionally contain a small amount of a surfactant, i.e., less than about 2 weight percent, and preferably from about 0.01 to about 2 weight percent. Suitable surfactants include any surfactant compatible with the cellulase and the fabric including, for example, anionic, non-ionic and ampholytic surfactants.

Suitable anionic surfactants for use herein include linear or branched alkylbenzenesulfonates; alkyl or alkenyl ether sulfates having linear or branched alkyl groups or alkenyl groups; alkyl or alkenyl sulfates; olefinsulfonates; alkanesulfonates and the like. Suitable counter ions for anionic surfactants include alkali metal ions such as sodium and potassium; alkaline earth metal ions such as calcium and magnesium; ammonium ion; and alkanolamines having 1 to 3 alkanol groups of carbon number 2 or 3.

Ampholytic surfactants include quaternary ammonium salt sulfonates, betaine-type ampholytic surfactants, and the like. Such ampholytic surfactants have both the positive and negative charged groups in the same molecule.

Nonionic surfactants generally comprise polyoxyalkylene ethers, as well as higher fatty acid alkanolamides or alkylene oxide adduct thereof, fatty acid glycerine monoesters, and the like.

The liquor ratios, i.e., the ratio of weight of cellulase solution to the weight of fabric, employed herein are generally from about 5:1 and greater, and preferably from about 5:1 to about 50:1 and more preferably from about 10:1 to about 30:1. Use of liquor ratios of greater than about 50:1 are not preferred from an economic viewpoint.

Reaction temperatures for cellulase treatment are governed by two competing factors. Firstly, higher temperatures generally correspond to enhanced reaction kinetics, i.e., faster reactions, which permit reduced reaction times as compared to reaction times required at lower temperatures. Accordingly, reaction temperatures are generally at least about 30° C. and greater. Secondly, cellulase is a protein which denatures at higher reaction temperatures. Thus, if the reaction temperature is permitted to go too high, then the cellulolytic activity is lost as a result of the denaturing of the cellulase. As a result, the maximum reaction temperatures employed herein are generally about 60° C. In view of the above, reaction temperatures are generally from about 30° C. to about 60° C.; and preferably, from about 35° C. to about 50° C.

As a result of agitation and cascading, the range of reaction time required to achieve improved feel and appearance in the cotton woven fabric is substantially shorter than those ranges heretofore employed. While the exact length of reaction time employed herein is dependent on factors such as the temperature of the cellulase solution, the concentration of cellulase in this solution, etc., improved feel in cotton woven fabric can preferably be achieved by the methods described herein within a reaction time of from about 0.25 to about 3 hours.

In a preferred embodiment, a concentrate can be prepared for use in the methods described herein Such concentrates would contain concentrated amounts of cellulase, buffer and surfactant, preferably in an aqueous solution. When so formulated, the concentrate can readily be added to water so as to quickly and accurately prepare cellulase solutions having the requisite concentration of these additives. Preferably, such concentrates will comprise from about 0.5 to about 20 weight percent cellulase (protein); from about 10 to about 50 weight percent buffer; from about 10 to about 50 weight percent surfactant; and from about 0 to 80 weight percent water. When aqueous concentrates are formulated, these concentrates can be diluted by factors of from about 5 to about 200 so as to arrive at the requisite concentration of the components in the cellulase solution. As is readily apparent, such concentrates will permit facile formulation of the cellulase solutions as well as permit feasible transportation of the concentration to the location where it will be used The following examples are offered to illustrate the present invention and should not be construed in any way as limiting its scope.

EXAMPLES

Example 1

Cotton sheeting (100% cotton, 200 count) obtained from Springs Industries, Fort Mill, S.C., as "Supercale Elite". The cotton sheeting was then cut into 15 inch squares and then numbered. Each square weighed approximately 19 g. Cellulase treatments were conducted in a laundrometer, which can accommodate up to 20 different fabric samples under different conditions in separate water tight canisters. Each fabric was folded over once and then gently rolled into cylinder shape and loaded into the canister. (Alternatively, the fabric can be crumpled into a ball and then inserted into the canister.) Different cellulase solutions were employed in each canister with the canisters filled to approximately 33% of their fill volume for liquor ratios of 20:1 and to approximately 17% of their fill volume for liquor ratios of 10:1. The cellulase concentration for each of these solutions is detailed in Table I. After heating the laundrometer's water bath to 125° F. (51.7° C.), the canisters were loaded onto the laundrometer's frame which was then rotated at 40 rpms for 60 minutes. Agitation and cascading are achieved under these conditions.

TABLE I

| Cellulase Solution[1] | Buffer[2] | Liquor Ratio[3] | Cellulase Concentration[4] |
|---|---|---|---|
| A | 0.05N | 10:1 | 0.13 g/liter |
| B | 0.05N | 10:1 | 0.26 g/liter |
| C | 0.05N | 10:1 | 0.52 g/liter |
| D | 0.05N | 20:1 | 0.06 g/liter |
| E | 0.05N | 20:1 | 0.13 g/liter |
| F | 0.05N | 20:1 | 0.26 g/liter |
| G | — | 10:1 | 0.52 g/liter |
| H | — | 20:1 | 0.52 g/liter |
| I | 0.05N | 10:1 | — g/liter |

[1]Cellulase employed in all of these examples was Cytolase 123 cellulase available from Genencor, South San Francisco, CA.
[2]Buffer = sodium acetate
[3]Liquor ratio is the ratio of weight of cellulase solution to the weight of fabric.
[4]Cellulase concentration is reported in grams of protein per liter of solution.

All cellulase solutions were initially adjusted to pH 5.0, and the laundrometer's bath was maintained at 125° F. Cellulase solution I is the control, e.g., an aqueous solution containing sodium acetate buffer but no cellulase.

After one hour of cellulase treatment, the cellulase treatment was terminated and the fabric samples were hand rinsed in hot water and placed into the tub of a washing machine filled with rinse water of 130°-140° F. (60°-65.5° C.). The fabric samples were allowed to undergo one rinse cycle (10 minutes) and then were pad nipped or extracted to remove excess water. The fabric samples were stretched over a spring-loaded frame in the warp direction and oven dried for 45 seconds at 250° F. (121.1° C.). Tensile strength was performed on the warp and filling, each sample, using a Scott Tester.

The treated fabric samples were then analyzed for improvements in both feel and appearance by three individuals. This analysis provided the following conclusions:

A. there was a detectable difference in both the appearance and feel of the fabrics treated with 0.13 gram/liter of cellulase solution (Cellulase solutions A and E) as compared to 0.52 grams/liter of cellulase solution at a liquor ratio of 10:1 (Cellulase solution C) with the fabric sample treated with the Cellulase solution C giving improved appearance and feel;

B. there was also a detectable difference in hand between the fabric samples treated with the 0.13 gram/liter cellulase solution (at a 10:1 liquor ratio) and the control (Cellulase solution I);

C. when the fabric sample treated with 0.26 g/liter cellulase solution was compared to control (Cellulase solution I), the surface fibers of the treated fabric sample appeared shorter in general and less fuzzy than the control and the weave in the treated fabric sample appeared to be more apparent than in the control;

D. fabric samples treated with cellulase solutions G and H lacked the improvement in feel and appearance characteristics that were obtained with the fabric samples treated with Cellulase solution C; and E. fabric samples treated with cellulase solutions D and I also lacked any improvement in feel and appearance.

The above results demonstrate that the methods of this invention result in improvements in both feel and appearance to the cotton woven fabric.

The tensile strength of the resulting fabric samples was determined. In general, fabric samples treated with the same enzyme concentration (in buffer) but at different liquor ratios gave similar tensile strengths indicating that liquor ratios are not critical. On the other hand, there were significant differences in tensile strength, especially filling tensile strength, with each increase of 1 gram/liter cellulase concentration indicating that the concentration of the cellulase is a critical parameter.

The results of these tensile strength determinations on the treated fabric are set forth in Table II below:

TABLE II

| Cellulase Solution | Tensile Strength[5] | |
|---|---|---|
| | Warp | Filling |
| A | 85 | 63 |
| B | 80 | 55 |
| C | 68 | 37 |

TABLE II-continued

| Cellulase Solution | Tensile Strength[5] | |
|---|---|---|
| | Warp | Filling |
| D | 82 | 63 |
| E | 82 | 66 |
| F | 80 | 52 |
| G | 85 | 72 |
| H | 91 | 81 |
| I | 94 | 69 |
| Fabric prior to treatment | 94 | 60 |

[5]Results are reported in lbs. and have a margin of error of about plus or minus 10 lbs.

The above data shows that when treated in the methods described herein, the reduction in warp tensile strength in fabric samples derived from cellulase solutions A through F was not significant as compared to the warp tensile strength of the fabric prior to treatment Likewise, except for the fabric obtained from treatment with Cellulase solution C, the reduction in filling tensile strength in fabric samples derived from cellulase solutions A through H were not significant as compared to the filling tensile strength of the fabric prior to treatment.

Example 2

Three samples of cotton woven fabric were treated with intermittent agitation and cascading by using a jig. The first cotton woven fabric sample was 100% cotton sheeting (200 count—Sample A); the second cotton woven fabric was 100% cotton twill (suitable for apparel—Sample B); and the third cotton woven fabric was a 60/40 twill of cotton and polyester (suitable for trousers and shirts—Sample C).

The cellulase solution employed in this example contained 1 gram/liter of Cytolase 123 cellulase (as protein), 0.05 N sodium acetate, and 0.5% Grescoterge JL 100 nonionic surfactant (commercially available from Gresco Mfg., Thomasville, N.C. 27360). Prior to treatment of the samples, the pH of the cellulase solution was adjusted to 5.0 and the temperature of this solution was maintained at 125° F. throughout the treatment period. The cellulase solution was maintained in an approximately 5 foot trough located between the rollers of the jig.

All three of the fabric samples, Samples A-C, were run through the jig together for 1 hour which resulted in 88 submersions into the cellulase solution per unit of fabric. After running the jig for one hour, small portions of each fabric were obtained and these portions were then thoroughly rinsed and dried. The jig was then run for an additional hour for a total run time of 2 hours and a total number of submersions of 176. At this time the cellulase solution was drained from the trough and the samples rinsed with hot water (200° F.) for 20 minutes. Fabric was removed from the jig and run through the frame with a pre-rinse in water at 120° F., then dried at 230° F. for one minute with a vacuum slot with a setting of 5 inches of mercury.

The fabric samples from both 1 hour and 2 hours were analyzed for thickness. The fabric samples before treatment as well as the samples treated for 2 hours were rated for feel and appearance.

Specifically, the fabrics (unmarked) to be rated for feel and appearance were provided to 7 individuals. The fabrics were visually evaluated for appearance and rated on a 1 to 10 scale The individuals were instructed prior to testing that the term "appearance" referred to the physical appearance of the cotton woven fabric to the eye and is determined in part, by the presence or absence of, fuzz, surface fibers, and the like on the surface of the fabric as well as by the ability or inability to discern the construction (weave) of the fabric. Fabrics which have little if any fuzz and surface fibers and wherein the construction (weave) is clearly discernable possess improved appearance as compared to fabrics having fuzz and/or loose fibers and/or an indiscernible weave. Accordingly, the rating assigned to each fabric is based on appearance qualities such as the presence or absence of fuzz and/or loose fibers and/or a discernible weave.

The scale has two standards to allow meaningful comparisons. The first standard is a test fabric of cotton sheeting (Style No. 467) available from Testfabrics, Inc. (200 Blackford Ave., Middlesex, N.J. 08846) which for the purposes of this analysis is assigned an appearance ranking of 3. The second standard is a test fabric of mercerized combed cotton broadcloth (Style No. 419) available from Testfabrics, Inc. (200 Blackford Ave., Middlesex, N.J. 08846) which for the purposes of this analysis is assigned an appearance rating of 7. The fabric to be rated was provided a rating of 3 or 7 if the fabric appears substantially the same as the first or second standard respectively. Rating of 1-2 represent fabrics having incrementally poorer appearances than the first standard; ratings of 8-10 represent fabrics having incrementally better appearances than the second standard; and ratings of 4-6 represent fabrics having incrementally better appearances than the first standard but incrementally poorer appearances than the second standard. After complete analysis of the fabrics, the values assigned to each fabric by all of the individuals were added and an average value generated.

The fabrics were also manually evaluated for feel and rated on a 1 to 10 scale. The individuals were instructed prior to testing that the term "feel" referred to the physical smoothness of a cotton woven fabric to touch. Fabrics having improved feel are smoother and silkier to the touch than other fabrics and are distinguished from qualities such as softness (which refers to the pliability of the fabric rather than its feel), thickness, color, or other physical characteristics not involved in smoothness of the fabric.

The fabrics are manually evaluated for feel and rated on a 1 to 10 scale by a minimum of seven individuals. The rating assigned to each fabric is based on feel qualities such as smoothness and silkiness, as defined above.

The scale has two standards to allow meaningful comparisons. The first standard is a test fabric of cotton twill (Style No. 471) available from Testfabrics, Inc. (200 Blackford Ave., Middlesex, N.J. 08846) which for the purposes of this analysis is assigned a rating of 3. The second standard is a test fabric of mercerized combed cotton broadcloth (Style No. 419) available from Testfabrics, Inc. (200 Blackford Ave., Middlesex, N.J. 08846) which for the purposes of this analysis is assigned a rating of 7. The fabric to be rated was given a rating of 3 or 7 if the fabric feels substantially the same as the first or second standard respectively. Rating of 1-2 represent fabrics having incrementally poorer feel than the first standard; ratings of 8-10 represent fabrics having incrementally better feel than the second standard; and ratings of 4-6 represent fabrics having incrementally better feel than the first standard but incrementally better feel than the second standard. After complete analysis of the two fabrics, the values assigned to each fabric were added and an average value generated.

The average of these results of the feel and appearance ratings of these samples are set forth in Table III below:

TABLE III

| | Appearance Rating | Feel Rating |
|---|---|---|
| Sample A (bef. treat.) | 4.0 | 8.4 |
| Sample A (aft. 2 hr treat.) | 8.1 | 9.1 |
| Sample B (bef. treat.) | 4.0 | 5.7 |
| Sample B (aft. 2 hr treat.) | 6.0 | 6.6 |
| Sample C (bef. treat.) | 4.6 | 5.3 |
| Sample C (aft. 2 hr treat.) | 5.0 | 5.4 |

The above data demonstrates that after two hours of treatment (aft. 2 hr treat.), Samples A–B possessed improvements in feel and appearance as compared to the samples before treatment (bef. treat.), i.e., there was at least a 0.5 number increase in the ratings of the treated samples as compared to the untreated samples. On the other hand, the above data demonstrates that after 2 hours of treatment, Sample C, while possessing some increase in the average values for feel and appearance, did not exhibit at least a 0.5 number increase in these values. This suggests that the treatment time and/or cellulase concentration employed with Sample C may need to be increased in order to obtain at least a 0.5 number increase.

Specifically, inspections of the samples after treatment showed the following:

A. Samples treated for one hour did not show any significant improvements in feel and appearance;

B. Samples A and B when treated for two hours had improvements in feel and appearance;

C. the surface of Sample B treated for two hours was uniform and free of short fibers or fuzz; and D. Samples A and B treated for two hours were devoid of loose yarn along the selvege edge.

In Sample C, the cotton portion of the selvege was removed, leaving only the polyester fibers.

Regarding thickness results, after 2 hours of treatment, Sample B showed no changes in thickness whereas the thickness of Sample A after 2 hours of treatment was reduced from 10 mils to 8.5–9.0 mils. Lastly, tensile strength data for the first two samples are set forth in Table IV below:

TABLE IV

| | Tensile Strength | | | |
|---|---|---|---|---|
| Sample | Warp | (% loss) | Fill | (% loss) |
| 100% Cotton Sheeting (untreated) | 87 | — | 74 | — |
| 100% Cotton Twill (untreated) | 139 | — | 49 | — |
| 100% Cotton Sheeting (treated 2 hrs) | 73 | 16% | 44 | 40% |
| 100% Cotton Twill (treated 2 hrs) | 112 | 16% | 33 | 33% |

Additionally, the reduction in tensile strength set forth above for samples treated for two hours was similar to the reduction found after one hour treatment time. The above data demonstrates that the reduction in tensile strength after two hours is less than 20% for the warp tensile strength and less than 50% for the filling tensile strength Similarly, by following the procedures set forth in Examples 1 and 2 above, other cellulases, including cellulase derived from organisms other than *Trichoderma reesei*, could be employed merely by substituting for CYTOLASE 123 cellulase. Other suitable cellulases which are commercially available and which could be employed herein include CELLUCLAST, RAPIDASE, and the like.

Similarly, any other art recognized devices which result in agitation and cascading can be employed in place of a laundrometer (in Example 1) and in place of a jig (in Example 2). For example, a jet, a beck a paddle machine, or a mercerizer could be employed in Example 2 in place of a jig.

What is claimed is:

1. A method of improving the physical smoothness to touch and the physical appearance to the eye characteristics of cotton woven fabric prior to the dyeing and finishing of said fabric which comprises contacting a non-dyed and non-finished cotton woven fabric with an aqueous cellulase solution containing a concentration of cellulase effective in improving said physical smoothness and said physical appearance characteristics of said non-dyed and non-finished fabric while maintaining the cellulase solution at a pH within the range where the cellulase exhibits activity and wherein said contacting is conducted with agitation under conditions so as to produce a cascading effect of the cellulase solution over the non-dyed and non-finished fabric and further wherein said contacting is conducted at a temperature and for a duration of time sufficient in improving said physical smoothness and said physical appearance characteristics of said non-dyed and non-finished cotton woven fabric by removing fuzz and loose surface fibers from said non-dyed and non-finished cotton woven fabric.

2. The method as described in claim 1 wherein said method also results in the removal of immature cotton fibers from the non-dyed and non-finished cotton woven fabric.

3. A method as described in claim 1 wherein the non-dyed and non-finished cotton woven fabric is contacted with the aqueous cellulase solution for a period of time of from about 0.25 hours to about 3 hours.

4. The method as described in claim 3 wherein the concentration of cellulase in said cellulase solution is from about 0.065 gram/liter to about 1 gram/liter.

5. The method as described in claim 4 wherein the concentration of cellulase in said cellulase solution is from about 0.2 gram/liter to about 0.4 gram/liter.

6. The method as described in claim 1 wherein said cellulase solution contains a sufficient concentration of buffer so as to maintain the pH of the solution within the range where the cellulase exhibits activity.

7. The method as described in claim 6 wherein the concentration of buffer in said cellulase solution is at least 0.01N.

8. The method as described in claim 1 wherein the temperature of said aqueous cellulase solution is from about 30° C. to about 60° C.

9. The method as described in claim 8 wherein the temperature of said aqueous cellulase solution is maintained from about 35° C. to about 50° C.

10. The method as described in claim 1 wherein the aqueous cellulase composition comprises water and cellulase at a ratio of about 5:1 or greater.

11. The method as described in claim 1 wherein said agitation is either continuous agitation or intermittent agitation.

12. The method as described in claim 11 wherein said agitation is continuous.

13. The method as described in claim 11 wherein said agitation is intermittent.

14. The method as described in claim 1 wherein after treatment of the non-dyed and non-finished cotton woven fabric with said cellulase solution, said non-dyed and non-finished cotton woven fabric retains at least 50% of its original warp tensile strength and at least 50% of its original filling tensile strength.

* * * * *

UNITED STATES PATENT AND TRADEMARK OFFICE

CERTIFICATE OF CORRECTION

PATENT NO. : 5,232,851
DATED : August 3, 1993
INVENTOR(S) : Cox et al.

It is certified that error appears in the above-indentified patent and that said Letters Patent is hereby corrected as shown below:

Column 1, line 23, where "o" should read --of--, and at line 34, where --.-- should be inserted after "appearance";

Column 3, line 54, where the second occurrence of "percent" should be deleted;

Column 4, line 6, where "fabric." should read --fabric,--, at line 26, where --.-- should be inserted after "reference", and at line 56, where --as Attorney Docket No. 010055-054 and-- should be inserted after "al.";

Column 5, line 13, where "23" should read --123--, at line 26, where --.-- should be inserted after "cellulase" and at line 65, where --.-- should be inserted after "employed";

Column 7, line 24, where "8846" should read --08846--, and at line 34, where "better" should read --poorer--;

Column 8, line 57, where --at-- should be inserted after "that";

Column 10, line 10, where --.-- should be inserted after the first occurrence of "fabric", at line 11, where "ft/sec" should read --6 ft/sec--, at line 32, where --.-- should be inserted after "cascading" and at line 67, where "contactin9" should read --contacting--;

Column 11, line 59, where --.-- should be inserted after "protein)";

Column 13, line 4, where --.-- should be inserted after "herein", and at line 38, where --a-- should be inserted after "into";

UNITED STATES PATENT AND TRADEMARK OFFICE

CERTIFICATE OF CORRECTION

PATENT NO. : 5,232,851
DATED : August 3, 1993
INVENTOR(S) : Cox et al.

It is certified that error appears in the above-indentified patent and that said Letters Patent is hereby corrected as shown below:

Column 14, line 16, where "filling," should read --filling of--;

Column 15, line 66, where --.-- should be inserted after "scale";

Column 16, line 67, where "better" should read --poorer--.

Signed and Sealed this

First Day of November, 1994

Bruce Lehman

*Attest:*

BRUCE LEHMAN

*Attesting Officer*

*Commissioner of Patents and Trademarks*